US011390969B1

(12) United States Patent
Aerts

(10) Patent No.: US 11,390,969 B1
(45) Date of Patent: Jul. 19, 2022

(54) WEBBING FOR FALL PROTECTION DEVICE

(71) Applicant: OTEX Specialty Narrow Fabrics, Inc., Bernardsville, NJ (US)

(72) Inventor: Eric Thomas Aerts, Warren, NJ (US)

(73) Assignee: OTEX Specialty Narrow Fabrics, Inc., Bernardsville, NJ (US)

( * ) Notice: Subject to any disclaimer, the term of this patent is extended or adjusted under 35 U.S.C. 154(b) by 247 days.

(21) Appl. No.: 16/752,984

(22) Filed: Jan. 27, 2020

(51) Int. Cl.
*D03D 15/513* (2021.01)
*D03D 13/00* (2006.01)
*D03D 1/00* (2006.01)

(52) U.S. Cl.
CPC ..... *D03D 1/007* (2013.01); *D03D 15/513* (2021.01); *D03D 1/0005* (2013.01); *D03D 13/00* (2013.01); *D10B 2331/042* (2013.01)

(58) Field of Classification Search
None
See application file for complete search history.

(56) References Cited

U.S. PATENT DOCUMENTS

| | | | |
|---|---|---|---|
| 5,677,056 | A | 10/1997 | Golz |
| 6,840,066 | B2 | 1/2005 | Dickerson |
| 7,815,013 | B2 | 10/2010 | Griffith |
| 7,866,245 | B2 | 1/2011 | Kempf et al. |
| 7,870,934 | B2 | 1/2011 | Ecker |
| 8,356,691 | B2 | 1/2013 | Griffith |
| 9,199,103 | B2 | 12/2015 | Hetrich et al. |
| 9,238,156 | B2 | 1/2016 | Apel et al. |
| 9,719,196 | B2 | 8/2017 | Salama et al. |
| 2008/0179136 | A1 | 7/2008 | Griffith |
| 2010/0101833 | A1 | 4/2010 | Zachariades et al. |
| 2012/0205478 | A1 | 8/2012 | Balquist et al. |
| 2014/0113519 | A1 | 4/2014 | Golz |
| 2015/0013079 | A1 | 1/2015 | Golz |
| 2016/0220857 | A1 | 8/2016 | Rappoport et al. |

FOREIGN PATENT DOCUMENTS

EP 1134313 * 9/2001

OTHER PUBLICATIONS

Islam, Shariful, et al., The Construction Principle of Double Cloth, Trends Textile Eng Fashion Technol., Feb. 8, 2018, pp. 1-10, vol. 1, Issue 2, Crimson Publishers, Bangladesh.

Sturges Manufacturing Co., Inc., Arc Flash SRL Webbing, Nov. 22, 2019, https://www.sturgesmfgco.com/webbing/fall-protection/arc-flash-webbing/arc-flash-srl-webbing/.

(Continued)

*Primary Examiner* — Shawn Mckinnon
(74) *Attorney, Agent, or Firm* — Timothy J. Monahan; Monahan & Company, LLC

(57) ABSTRACT

A webbing for use in a fall protection device, such as a self-retracting lifeline having leading edge capabilities, is provided having a double cloth construction with the exterior of the webbing constructed of woven, UV-resistant, liquid-crystal aromatic polyester yarns and having stuffer yarns positioned in the interior of the fabric, wherein the stuffer yarns are made of high-tenacity fibers, having a melting point of 280° C. or greater. The webbing meets ANSI Standard Z359.14 for leading edge applications, and is arc-flash protective in compliance with ASTM F887.

20 Claims, 2 Drawing Sheets

(56) References Cited

OTHER PUBLICATIONS

Sturges Manufacturing Co., Inc., Leading Edge Webbing, Oct. 25, 2019, https://www.sturgesmfgco.com/webbing/fall-protection/leading-edge-webbing/.
Otex Specialty Narrow Fabrics, Aerospace Webbing, Ropes & Tapes UL & NFPA Compliant, Oct. 25, 2019, osnf.com/aerospece-webbing.
Otex Specialty Narrow Fabrics, Product Fact Sheet for 1" Sentry Lifeline, Item No. 447535711.000BG, Issued May 2018.
Gupta, Amit, Improving UV Resistance of High Strength Fibers, May 2005, pp. iv-vii, 4-8, 44-47, 120-123.

* cited by examiner

WEBBING FOR FALL PROTECTION DEVICE

This invention relates to narrow textile fabrics in the form of webbing for use in a fall protection device. In particular, the webbing of the present invention is suitable for leading edge applications and is arc-flash resistant, in compliance with ASTM F887.

BACKGROUND OF THE INVENTION

Fall protection systems typically incorporate (i) a harness worn by a worker; (ii) a self-retracting lifeline; and (iii) an anchor connected to the free end of the lifeline. If a worker falls, a locking mechanism in the housing prevents the pay out of the lifeline, thereby arresting the fall. A leading edge application is a working surface with a sharp or abrasive edge, such as a steel girder, which places additional stress on the lifeline, should a worker fall. Additionally, many applications for fall protection devices involve exposure to arc-flash hazards.

Various fall protection systems have been developed, which incorporate a textile made of high modulus synthetic fibers as the lifeline. Ecker—U.S. Pat. No. 7,870,934 B2 discloses a self-retracting lifeline and braking system, which may incorporate a nylon webbing. Zachariades et al.—Patent Application Publication No. US 2010/0101833 A1 disclose a braid construction for a rope having a braided inner layer of an aromatic polyamide, such as Kevlar, and a braided outer layer of ultra-high molecular weight polyethylene tape. Balquist et al.—U.S. Pat. No. 9,913,999 B2 disclose a retracting lifeline system incorporating a webbing having an interior of a high strength or high tenacity fiber selected from aramid fibers and ultra-high molecular weight polyethylene, and an abrasion resistant exterior selected from a weave of Vectran fibers and spun polyester fibers. Salama et al.—U.S. Pat. No. 9,719,196 B2 disclose various high tensile strength-to-weight ratio fibers useful for interlocking weave performance fabrics.

Rappoport et al.—Patent Application Publication US 201610220857 A1 disclose a lifeline for a fall protection system incorporating a webbing made from high tenacity fibers. The threads forming the edge of the webbing are characterized by outer edge threads and inner edge threads. The outer edge threads and inner edge threads are provided in contrasting colors. When the outer edge threads are worn, the inner edge threads are exposed, thereby indicating that the lifeline may need to be replaced.

Despite the developments in the field of fall protection, there remains a need for a lifeline for use in a fall protection system that is abrasion and cut resistant, high strength, able to absorb the shock of a person falling, flexible, lightweight, compact, and provides protection from arc-flash hazards.

SUMMARY OF THE INVENTION

A webbing is provided having a double cloth woven construction enveloping a plurality of stuffer yarns. The webbing has two exterior sides and two side edges. Each of the sides is comprised of a plurality of warp yarns, also referred to a ends, interlaced crosswise multiple times along the length of the webbing with a weft yarn, also referred to as a filling yarn. Each insertion of the weft yarn through the warp yarns is referred to as a pick. The warp yarns are multifilament, polymer yarns comprised of UV-resistant, liquid-crystal aromatic polyester fibers. The weft yarn is a multifilament, polymer yarn comprised of high-tenacity fibers having a melting point of 280° C. or greater, which may be UV-resistant, liquid-crystal aromatic polyester fibers or a different high-tenacity fiber. The warp and weft yarns may be interlaced to create a plain, twill or satin weave, or a combination thereof.

The first side and second side are joined together by binder yarns extending between the first side and the second side of the webbing, thereby joining the sides together. By way of example, the double construction may be self-stitched, center stitched, or stitched by yarn interchange. The binder may be a multifilament yarn comprised of high-tenacity fibers having a melting point of 280° C. or greater.

A plurality of stuffer yarns are sandwiched between the first side and the second side of the double cloth and extend in the warp direction. The stuffer yarns are multifilament, polymer yarns comprised of high-tenacity fibers having a melting point of 280° C. or greater, which provide strength and resilience to the webbing. The stuffer yarns may be provided as a cord, that is, the stuffer yarns are plied together and the plied yarns are twisted into a cord, to improve strength and stability and to facilitate weaving. The stuffer yarns are held in place by the binder yarns, and in certain embodiments, by a continuous weft yarn encircling the first side and second side of the double cloth in a spiral, thereby joining their edges together. A catch cord may be employed along the edges of the webbing to lock the weft yarns in place and secure the stuffer yarns within the interior of the webbing.

A feature of the present invention is the concentration of the warp yarns at the exterior or face of each side of the webbing, that is, the warp yarns are predominantly exposed at the face of each side of the webbing, relative to the weft yarn. Accordingly, the UV-resistant, liquid-crystal aromatic polyester fibers, which have superior abrasion resistance and cut resistance, are exposed to a leading edge in a fall protection application. Furthermore, in the case of a fall, the webbing will be dragged lengthwise along a leading edge, and it is believed to be advantageous for the yarns running lengthwise in the webbing, that is, the warp yarns, to engage the leading edge, rather than the weft yarn, to minimize snagging.

The objectives of the invention may be accomplished by one or more of the following constructions, or combinations thereof. The warp yarns may be provided in significantly higher concentration than the weft yarn. By way of example, the ratio of the ends per inch of warp yarns comprised of ultra-high molecular weight polyethylene to the picks per inch in the woven sides of the webbing may be 2:1 or greater, particularly, 3:1 or greater, more particularly 4:1 or greater. A single weft yarn may be employed, whereby the weft yarn is first interlaced with the warp yarns in the first side of the webbing. Next, the weft yarn encircles a first edge of the webbing and is interlaced with the warp yarns in the second side of the webbing. Then, the weft yarn encircles the second edge of the webbing and is again interlaced with the warp yarns in the first side of the webbing at a farther distance along the length of the webbing, thereby creating a continuous spiral. It can be understood that by controlling the tension of the weft yarn, the warp yarns are drawn together, forcing the exposure of the warp yarns on the face of each side of the webbing. An additional technique for improving the performance of the webbing in leading edge, fall protection applications is to minimize the picks per inch of the weft yarn to 24 ppi or less, in particular, from 6 to 18 ppi, more particularly, from 8 to 16 ppi, per side.

The webbing of the present invention has application in fall protection devices, especially due to the combination of the webbing's abrasion and cut resistance, high tensile strength, flexibility, compact volume, and suitability for applications involving arc-flash hazards. The webbing may also be used in other applications where a high tensile strength webbing is desirable, such as towing, climbing, load securing, passenger restraint in vehicles, military apparel, furniture, aerospace, first responder equipment and apparel, medical equipment, tactical gear and the like.

The drawings are provided to illustrate the arrangement of the various yarns that make up the construction of the webbing of the present invention, but are not intended to show the precise number of yarns.

DETAILED DESCRIPTION OF THE INVENTION

Without limiting the scope of the invention, the preferred embodiments and features are hereinafter set forth. All of the United States patents and published patent applications cited in the specification are hereby incorporated by reference. Unless otherwise indicated, concentrations are by weight and molecular weight is based on weight average molecular weight. The term "polymer" as used in the present application denotes a material having a weight average molecular weight ($M_w$) of at least 5,000. The term "polymer" is used in its broad sense to include homopolymers, and polymers containing two or more different monomer units, such as copolymers and terpolymers, and unless otherwise indicated, includes random, block and statistical polymers. The term "yarn" includes (i) monofilament; (ii) a plurality of continuous filaments laid together, with or without twist; and (iii) staple fibers twisted together. The term "multifilament yarn" is used to identify a yarn having a plurality of continuous filaments laid together, with or without twist. Yarns may be in the form of individual strands, multiple strands plied together, or multiple plied strands twisted together to form cord. Melting point is determined by differential scanning calorimetry ("DSC"). When a polymeric fiber is characterized as having a melting point at or greater than a specified temperature, the characterization is intended to include materials that decompose prior to melting, but not until reaching or exceeding the specified melting point. Unless otherwise indicated, the ASTM test method in effect at the earliest priority date of the present invention is the intended reference.

Figure 1:
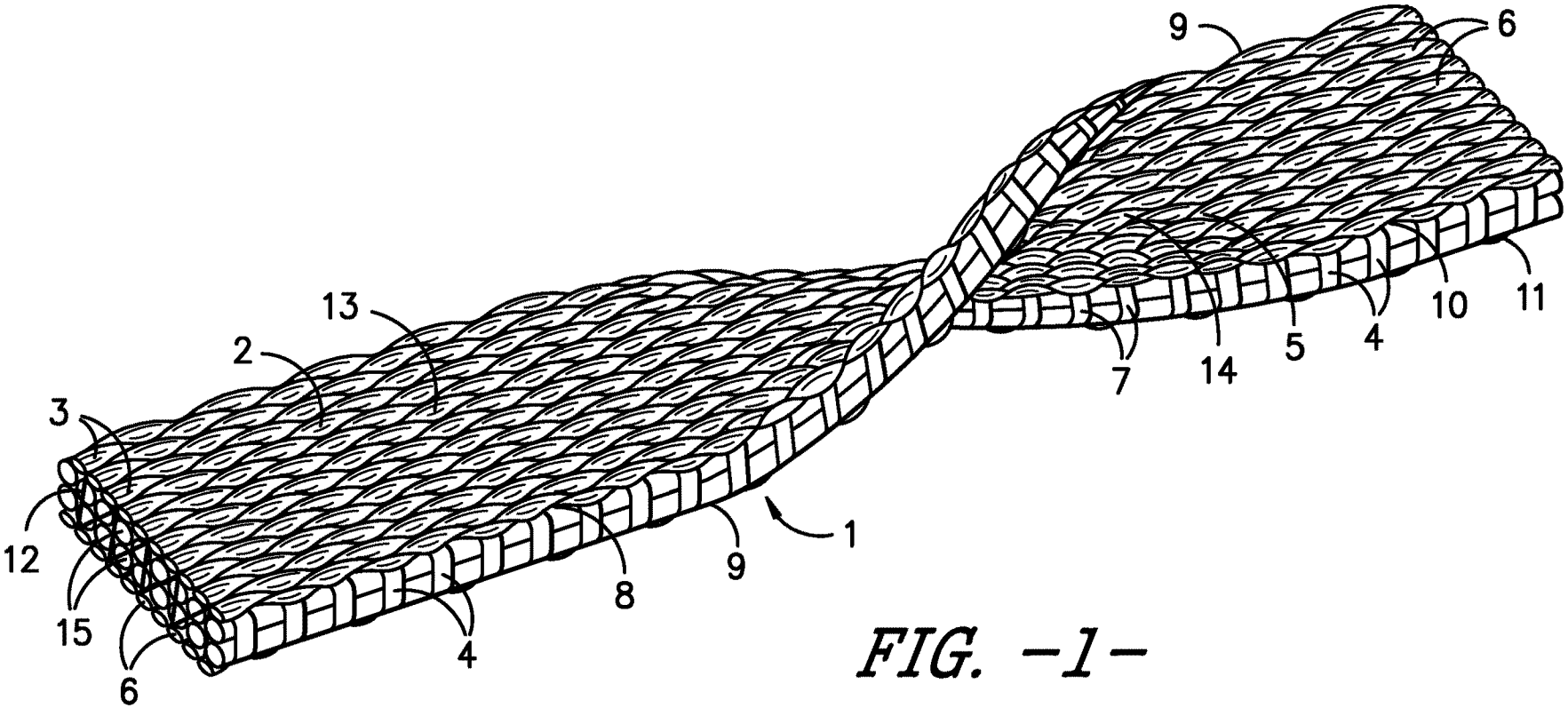
FIG. 1 is a perspective view of the webbing with a h twist to show both sides.

Referring to FIG. 1, webbing 1 is a double cloth construction. Webbing 1 has side 2 with warp yarns 3 and went yarns 4, woven together. Webbing 1 is shown with a ½ twist in FIG. 1 to illustrate side 5, opposite from side 2. In the embodiment shown, weft yarn 4 from side 2 wraps around edge 8 of side 2 and edge 9 of side 5, before being inserted through warp yarns 6 of side 5. Next, weft yarn 4 emerges from edge 10 of side 5 and wraps around edge 11 of side 2. Thus, weft yarn 4 continuously wraps webbing 1 in a spiral to join the edges of side 2 and side 5 together.

It can be understood that instead of continuously wrapping weft yarns 4 around edges 8-11, weft yarn 4 may be interlaced with warp yarns 3 of side 2 and weft yarns 7 may be interlaced with warp yarns 6 of side 5, and for example, locked in place by a catch cord. Accordingly, as used herein, the term "weft yarn" refers to either a set of yarns that interlace with the warp yarns of a single side, or a single yarn that interlaces with the warp yarns on one side of the webbing and is wrapped around the edges to interlace with the warp yarns on a second side of the webbing, etc.

Warp yarns 3 and warp yarns 6 are multifilament, polymer yarns comprised of UV-resistant, liquid-crystal aromatic polyester fibers, also known as LCP (liquid-crystal polymer) aromatic polyester fiber. The UV-resistant, liquid-crystal aromatic polyester fibers may have a molecular weight of 3 million or greater. By way of example, the warp yarns may range in denier from 1200d to 2000d, with a filament count of from 500 to 1500. In the example illustrated in FIG. 1, all of warp yarns 3 and 6 may be comprised of UV-resistant, liquid-crystal aromatic polyester fibers. It can be understood that the invention may be practiced with a plurality of the warp yarns being comprised of UV-resistant, liquid-crystal aromatic polyester fibers and other warp yarns being comprised of a different material. In certain embodiments, 50% by weight of the warp yarns are UV-resistant, liquid-crystal aromatic polyester fibers, in particular 66% by weight of the warp yarns are UV-resistant, liquid-crystal aromatic polyester fibers, and more particularly, 75% by weight of the warp yarns forming woven sides 2 and 5 are UV-resistant, liquid-crystal aromatic polyester fibers.

Liquid-crystal aromatic polyester fibers may be made UV resistant by one or a combination of treatments or additives. By way of example, UV-resistant, liquid-crystal aromatic polyester fibers useful in the present invention may (a) incorporate or be coated with an antioxidant, such as a kinetic chain breaking antioxidant or a peroxide decomposer; (b) incorporate or be coated with a photostabilizer, such as a UV absorber, inhibitor, stabilizer, quencher, decomposer, or singlet oxygen quencher; or (c) incorporate or be coated with an inorganic or organic pigment, such as titanium dioxide, zinc oxide or carbon. The UV-resistant, liquid-crystal aromatic polyester fibers may be made by treating commercially available liquid-crystal aromatic polyester fibers, such as Vectran®. For example, the additive may be provided in solution or suspension, with a suitable binder, applied to the surface of the fiber and dried and/or cured, as necessary to achieve the desired add-on level. By way of example, Vectran® provided with a UV resistant coating is available under the PROTEXCOAT trademark from Fiber-Line® Inc., Hatfield, Pa., USA. Alternatively, the additive may be incorporated into the polymer melt prior to extruding or spinning the polymer in the shape of filaments.

Weft yarns 4 (and 7 when applicable) may be comprised of UV-resistant, liquid-crystal aromatic polyester fibers. In certain embodiments, 50% by weight of the weft yarns are UV-resistant, liquid-crystal aromatic polyester fibers, in particular 66% by weight of the weft yarns are UV-resistant, liquid-crystal aromatic polyester fibers, and more particularly, 75% by weight of the weft yarns forming woven sides 2 and 5 are UV-resistant, liquid-crystal aromatic polyester fibers. Alternatively, weft yarns 4 may be comprised of high-tenacity fibers other than UV-resistant, liquid-crystal aromatic polyester fibers, for example, a multifilament, high-tenacity yarn having a melting point of having a melting point of 280° C. or greater, in particular, a melting point of 300° C. or greater.

The relative amount of warp yarns to weft yarns in each of the woven sides of the webbing may be expressed as a weight ratio. Accordingly, the weight of the warp yarns to the weight of weft yarns may be 2:1 or greater, in particular 3:1 or greater or even 3.5:1 or greater.

Side 2 and side 5 are joined together by binder yarns 12, extending between the two sides of webbing 1, thereby joining the two sides together, as shown in FIG. 1. By way of example, the double construction may be self-stitched, center stitched, or stitched by yarn interchange. Binder yarns 12 may be comprised of UV-resistant, liquid-crystal aromatic polyester fibers, or binder yarns 12 may be comprised of yarns of high-tenacity fibers, other than UV-resistant, liquid-crystal aromatic polyester fibers.

Side 2 and side 5 may be a plain, twill or satin weave. For example, face 13 of side 2 may be a 1×1 or 2×2 plain weave or a warp face twill weave, such as a 2/1, 3/1 or 4/1 twill weave. Face 14 of side 5 may be the same weave as side 2 or different. By way of example, the weave construction of each of sides 2 and 5 may be the same or different and range from 25 to 125 ends per inch and from 5 to 25 picks per inch, in particular from 40 to 100 ends per inch and from 6 to 18 picks per inch. In order to maximize the benefits of the UV-resistant, liquid-crystal aromatic polyester warp yarns, especially in fall protection applications, side 2 and side 5 may be constructed to increase the exposure of warp yarns 3 and warp yarns 6, respectively, relative to the weft yarns. In order to increase the number of warp yarns woven into each side of webbing 1, the warp yarns may be woven in pairs, or as plies of two or more yarns, or as cords of two or more plies.

Stuffer yarns 15 are positioned between side 2 and side 5 of webbing 1. Stuffer yarns 15 are multifilament yarns comprised of high-tenacity fibers having a melting point of 280° C. or greater, in particular, a melting point of 300° C. or greater. The term "high-tenacity" fibers is intended to include liquid-crystal aromatic polyester fibers, such as Vectran, aramid fibers, such as para-aramid, for example Kevlar®, meta-aramid, for example Nomex®, poly(p-phenylene-2,6-benzobisoxazole), such as Zylon®, and other fibers having a tensile strength of 2.0 GPa or greater, in particular 2.5 GPa or greater, more particularly 3.0 GPa or greater, as well as combinations thereof. In one embodiment of the invention, stuffer yarns 15 comprise a high-tenacity fiber other than liquid-crystal aromatic polyester fibers, in particular, a para-aramid fiber, such as Kevlar®.

Stuffer yarns 15 may range in denier from 800d to 2000d, with a filament count of from 500 to 1500. The ends per inch of stuffer yarns may range from 100 to 250. In one embodiment of the invention, the stuffer yarns are provided as a cord, that is, the stuffer yarns are plied together and the plied yarns are twisted into a cord, to improve strength and stability and to facilitate weaving. By way of example, the stuffer yarns may be used as 2×3 or 3×4 cords, with the first number representing the number of single yarns plied together to create a plied yarn, and the second number representing the number of plied yarns twisted together to create a cord. By way of further example, 10 to 20 cords, representing 60 to 240 single yarns, may be used.

The ratio of the combined weight of side 2 and side 5 to the weight of stuffer yarns 15 may range from 1:3 to 3:1, in particular, from 1:2 to 2:1, and more particularly from 1:1.5 to 1.5:1.

In one embodiment of the invention, the double cloth construction consists essentially of UV-resistant, liquid-crystal aromatic polyester yarns in the warp and weft of both sides, as well as UV-resistant, liquid-crystal aromatic polyester stuffer yarns. The binder yarns may be UV-resistant, liquid-crystal aromatic polyester yarns, as well.

Webbing made according to teachings herein may have a tensile strength of 6,000 lbs. or greater per one inch width of webbing, as measured by ASTM D6775-13 (2017).

Figure 2:
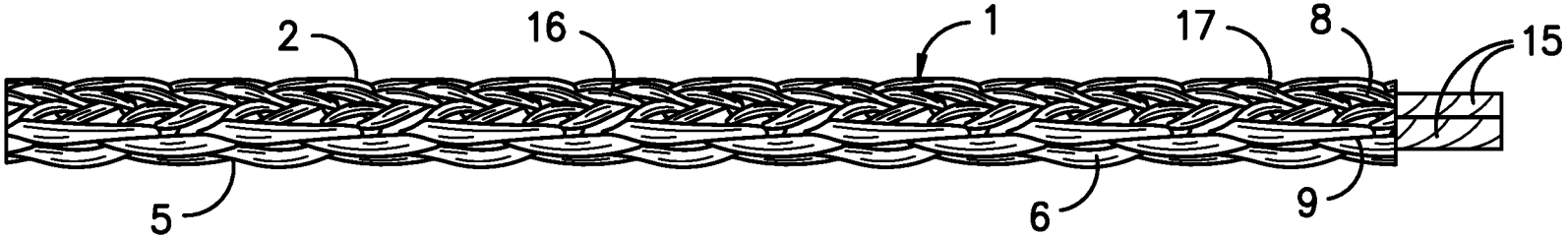
FIG. 2 is a side view of the webbing showing the catch cord stitched into the side of the webbing.

Referring to FIG. 2, edges 8 and 9 and edges 10 and 11 may be provided with catch cord 16 and catch cord 17, respectively, to prevent webbing 1 from unraveling. Examples of the use of a catch cord may be found in U.S. Pat. No. 5,677,056. The catch cord may be a UV-resistant, liquid-crystal aromatic polyester yarn.

Figure 3:
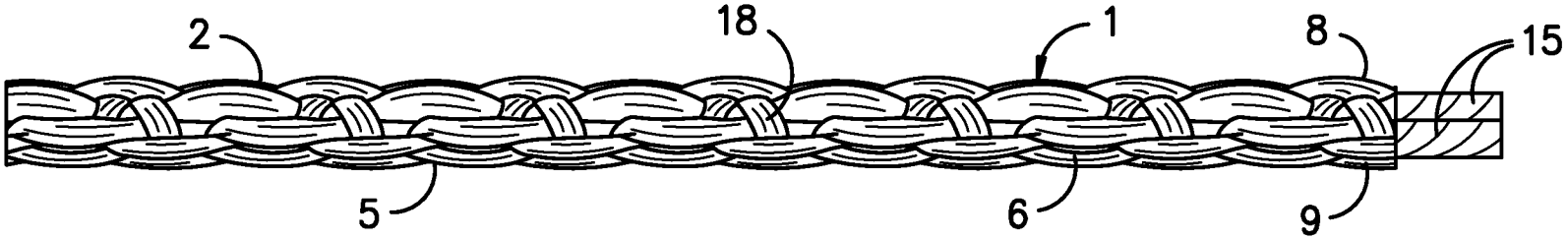
FIG. 3 is a side view of the webbing showing an indicator yarn stitched into the side of the webbing.

Other fibers or yarns may be incorporated in webbing 1 for identification or to detect wear, as is known in the art, and illustrated by indicator yarn 18 in FIG. 3.

The webbing of the present invention is designed for use in self-retracting lifelines that meet ANSI Standard Z359.14. Furthermore, because of the abrasion resistance and cut resistance of the outside of the webbing, the webbing is suitable for use in self-retracting lifelines having leading edge capabilities, referred to as SRL-LE devices. Accordingly, the present invention includes a self-retracting lifeline incorporating the webbing disclosed herein, in particular, a self-retracting lifeline that meets or exceeds ANSI Standard Z359.14 and standards for self-retracting lifelines having leading edge capabilities.

The webbing of the present invention provides arc-flash protection, in compliance with ASTM F887 (2018). For example, the webbing can be tailored to meet ASTM F887 at testing exposures of 40 cal/cm$^2$ or greater. Additionally, webbing constructed according to the present invention may be designed to comply with the requirements for self-extinguishing fabric under ASTM F1506, which incorporates the requirements of ASTM D6413.

Example 1

A double cloth, plain weave webbing was produced on a needle loom. Each side of the webbing was constructed of 48 ends of 1600d, 1000 filament UV-resistant, liquid-crystal aromatic polyester yarns and 24 ends of 1000d, 192 filament UV-resistant, liquid-crystal aromatic polyester yarns along the edges of the webbing, and 12±2 ppi of 1600d, 1000 filament UV-resistant, liquid-crystal aromatic polyester yarns. The stuffer yarns were 1500d, 3×4 cord constructed from UV-resistant, liquid-crystal aromatic polyester and 14 cords (168 yarns) were positioned between the front and back sides of the webbing. Binder yarns of 1600d, 1000 filament UV-resistant, liquid-crystal aromatic polyester yarn binder were woven between the front and back to secure the sides together. A UV-resistant, liquid-crystal aromatic polyester catch cord (1000d1192/1.5z) was used to bind the edges of the webbing. The UV-resistant, liquid-crystal polyester yarns were made from Vectran® having a coating containing UV inhibitors, absorbers and stabilizers.

The webbing had a width of approximately 1.0 inches, a thickness of approximately 0.14 inches and a weight of approximately 58 g/linear yard. The tensile strength of the webbing was approximately 8,000 lbs. The webbing was compliant with ASTM F887 (2018), when tested at an exposure level of 40 cal/cm$^2$.

Self-Retracting Lifeline

The webbing of the present invention is particularly useful as the lifeline component in a self-retracting lifeline. Typically, a self-retracting lifeline includes a housing having a rotatable drum mounted on a shaft within the housing. The lifeline is wound around the drum. A snap hook at the free end of the lifeline is anchored to a stationary object, when a worker is operating at a potentially dangerous height. When the lifeline is paid out slowly, a spring mechanism within the housing maintains tension on the lifeline, to remove slack. If, however, the worker falls, a locking engages to prevent the lifeline from paying out, thereby arresting the fall. The locking mechanism may also incorporate a braking assembly, to prevent injury caused by an abrupt stop of downward motion, as disclosed in U.S. Pat. No. 9,199,103 B2.

In one or more embodiments of the present invention, the webbing is free of conductive metal cables, thereby avoiding various drawbacks, including the extra weight associated with metal cable and the risk of metal cable kinking and catching on sharp edges, which can negate the protection of shock absorbers incorporated in self-retracting lifeline assemblies.

There, of course, many alternative embodiments and modifications of the invention, which are intended to be included in the following claims.

What I claim is:

1. A webbing comprising:

(a) a double cloth construction having (i) a first side having a plurality of warp yarns and weft yarns woven together, wherein the warp yarns are multifilament yarns comprised of UV-resistant, liquid-crystal aromatic polyester fibers; (ii) a second side having a plurality of warp yarns and weft yarns woven together, wherein the warp yarns are multifilament yarns comprised of UV-resistant, liquid-crystal aromatic polyester fibers; and (iii) a plurality of binder yarns extending between the first side and second side, whereby the binder yarns joins the first and second side together;

(b) a plurality of stuffer yarns positioned between the first side and second side of the double cloth and extending in the warp direction, wherein the stuffer yarns are multifilament yarns comprised of fibers selected from high-tenacity fibers having a melting point of 280° C. or greater and a tensile strength of 2.0 GPa or greater;

(c) the webbing meets ANSI Standard Z359.14;

(d) the webbing passes ASTM F887 for arc-flash protection, and (e) wherein the webbing is free of conductive metal.

2. The webbing of claim 1, wherein the weft yarns in the first side and second side are comprised of multifilament UV-resistant, liquid-crystal aromatic polyester fibers.

3. The webbing of claim 1, wherein the stuffer yarns are in the form of cords.

4. The webbing of claim 1, wherein the first side has a first edge and a second edge and the second side has first edge and a second edge, and the weft yarns are continuously wrapped from the first side to the second side, thereby joining the (i) first edge of the first side to the first edge of the second side, and (ii) the second edge of the first side to the second edge of the second side.

5. The webbing of claim 1, wherein first side of the double cloth has a face and the warp yarns of first side are predominantly exposed on the face relative to the weft yarns, and wherein the second side of the double cloth has a face and the warp yarns of the second side are predominantly exposed on the face relative to the weft yarns.

6. The webbing of claim 5, wherein the first side and the second side are plain weaves, and the ratio of ends per inch of warp yarns comprised of UV-resistant, liquid-crystal aromatic polyester fibers to picks per inch in each side of the webbing is 2:1 or greater.

7. The webbing of claim 5, wherein the ratio of ends per inch of warp yarns comprised of UV-resistant, liquid-crystal aromatic polyester fibers to picks per inch in each of the first side and second side of the webbing is 3:1 or greater.

8. The webbing of claim 5, wherein the ratio of ends per inch of warp yarns comprised of UV-resistant, liquid-crystal aromatic polyester fibers to picks per inch in each of the first side and second side of the webbing is 4:1 or greater.

9. The webbing of claim 1, wherein the webbing is self-extinguishing in compliance with ASTM F1506.

10. The webbing of claim 1, wherein the warp yarns in the first side and second side have a denier of from 1200d to 2000d, and the first side and the second side each have from 25 to 125 warp yarns per inch.

11. The webbing of claim 1, wherein the weft yarns in the first side and second side have a denier of from 1200d to 2000d, and the first side and the second side each have from 6 to 18 weft yarns per inch (ppi).

12. The webbing of claim 1, wherein the stuffer yarns have a denier of from 800d to 2000d, and the stuffer yarns are provided in the form of cords, within a range of from 100 to 250 ends per inch.

13. The webbing of claim 1, wherein the stuffer yarns comprise a high-tenacity fiber having a tensile strength of 3.0 GPa or greater.

14. The webbing of claim 1, wherein the ratio of the combined weight of the first side and the second side to the weight of stuffer yarns ranges from 1:2 to 2:1.

15. The webbing of claim 1, wherein the warp yarns and the weft yarns in the first side and the second side of the webbing and the stuffer yarns consist essentially of UV-resistant, liquid-crystal aromatic polyester fibers.

16. In a self-retracting lifeline incorporating a webbing as the lifeline, an improvement comprising the webbing of claim 1.

17. The self-retracting lifeline of claim 16, wherein the first side of the double cloth has a face and the warp yarns of first side are predominantly exposed on the face relative to the weft yarns, and wherein the second side of the double cloth has a face and the warp yarns of the second side are predominantly exposed on the face relative to the weft yarns.

18. The self-retracting lifeline of claim 16, wherein the webbing is self-extinguishing in compliance with ASTM F1506.

19. The webbing of claim 1, wherein 75% by weight of the warp yarns and 75% by weight of the weft yarns in the first side and the second side of the webbing are UV-resistant, liquid-crystal aromatic polyester fibers.

20. The webbing of claim 1, wherein the UV-resistant, liquid-crystal polyester fibers are provided with a UV-resistant coating.

* * * * *